US011499255B2

(12) United States Patent
Baker et al.

(10) Patent No.: US 11,499,255 B2
(45) Date of Patent: Nov. 15, 2022

(54) TEXTILE PRODUCT HAVING REDUCED DENSITY

(71) Applicant: Apple Inc., Cupertino, CA (US)

(72) Inventors: John J. Baker, Campbell, CA (US); Michael B. Howes, San Jose, CA (US); Michael S. Nashner, San Jose, CA (US); Yoji Hamada, Wakayama-ken (JP)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/858,375

(22) Filed: Apr. 24, 2020

(65) Prior Publication Data

US 2020/0255996 A1 Aug. 13, 2020

Related U.S. Application Data

(63) Continuation of application No. 15/598,146, filed on May 17, 2017, now abandoned, which is a (Continued)

(51) Int. Cl.
*B32B 1/02* (2006.01)
*D04H 13/00* (2006.01)
(Continued)

(52) U.S. Cl.
CPC ..... *D04H 13/00* (2013.01); *D04H 1/00* (2013.01); *Y10T 428/13* (2015.01); *Y10T 428/24992* (2015.01)

(58) Field of Classification Search
CPC ... B32B 1/02; Y10T 428/1352; Y10T 428/15; Y10T 428/24314; B65D 75/58;
(Continued)

(56) References Cited

U.S. PATENT DOCUMENTS 1,893,291 A 1/1933 Kwartin
3,474,196 A * 10/1969 Bottos ..... H04M 1/03 379/422
(Continued)

FOREIGN PATENT DOCUMENTS

EP 2094032 8/2009
GB 2103933 A 3/1983
(Continued)

OTHER PUBLICATIONS

Baechtle et al., "Adjustable Audio Indicator," IBM, 2 pages, Jul. 1, 1984.
(Continued)

*Primary Examiner* — Marc A Patterson
(74) *Attorney, Agent, or Firm* — David K. Cole

(57) ABSTRACT

Embodiments described herein may take the form of a textile product having one or more regions of reduced density. These reduced density volumes may form one or more features in the product. For example, the reduced density volumes may have better acoustic transmission properties, optical transmission properties, flexibility, and the like. Sound transmission may be enhanced not only in terms of clarity, but also overall range. That is, certain audio frequencies that the textile may normally block when in an unaltered state may pass through a textile having reduced density or reduced density regions.

10 Claims, 7 Drawing Sheets

Related U.S. Application Data continuation of application No. 13/802,460, filed on Mar. 13, 2013, now abandoned.

(51) Int. Cl.
*D04H 1/00* (2006.01)
*B32B 1/08* (2006.01)

(58) Field of Classification Search
CPC ..... B65D 75/5805; B65D 75/5811; B65D 75/5816; B65D 75/5822; B65D 75/5827; B65D 75/5833; B65D 75/5844; B65D 75/585; B65D 75/5855; B65D 75/5861; B65D 75/5866; B65D 75/5872; B65D 75/5877; B65D 75/5883; B65D 75/5888; B65D 75/5994; H04R 25/65
USPC ..... 428/35.7
See application file for complete search history.

(56) References Cited

U.S. PATENT DOCUMENTS

| | | | | |
|---|---|---|---|---|
| 3,906,130 | A | 9/1975 | Tsurumi et al. | |
| 4,081,631 | A | 3/1978 | Feder | |
| 4,658,425 | A | 4/1987 | Julstrom | |
| 4,704,112 | A | 11/1987 | Suzuki et al. | |
| 4,736,418 | A * | 4/1988 | Steadman | H04M 1/03 379/440 |
| 5,293,002 | A | 3/1994 | Grenet et al. | |
| 5,335,011 | A | 8/1994 | Addeo et al. | |
| 5,406,038 | A | 4/1995 | Reiff et al. | |
| 5,570,324 | A | 10/1996 | Geil | |
| 5,619,583 | A | 4/1997 | Page et al. | |
| 5,814,389 | A | 9/1998 | Giacometti | |
| 5,862,215 | A * | 1/1999 | Garriette | H04M 1/17 379/452 |
| 5,879,598 | A | 3/1999 | McGrane | |
| 6,073,033 | A | 6/2000 | Campo | |
| 6,129,582 | A | 10/2000 | Wilhite et al. | |
| 6,151,401 | A | 11/2000 | Annaratone | |
| 6,154,551 | A | 11/2000 | Frenkel | |
| 6,192,253 | B1 | 2/2001 | Charlier et al. | |
| 6,228,462 | B1 | 5/2001 | Lee et al. | |
| 6,317,237 | B1 | 11/2001 | Nakao et al. | |
| 6,813,218 | B1 | 11/2004 | Antonelli et al. | |
| 6,829,018 | B2 | 12/2004 | Lin et al. | |
| 6,882,335 | B2 | 4/2005 | Saarinen | |
| 6,934,394 | B1 | 8/2005 | Anderson | |
| 7,003,099 | B1 | 2/2006 | Zhang et al. | |
| 7,082,322 | B2 | 7/2006 | Harano | |
| 7,154,526 | B2 | 12/2006 | Foote et al. | |
| 7,158,647 | B2 | 1/2007 | Azima et al. | |
| 7,263,373 | B2 | 8/2007 | Mattisson | |
| 7,266,189 | B1 | 9/2007 | Day | |
| 7,378,963 | B1 | 5/2008 | Begault et al. | |
| 7,536,029 | B2 | 5/2009 | Choi et al. | |
| 7,570,772 | B2 | 8/2009 | Sorensen et al. | |
| 7,966,785 | B2 | 6/2011 | Zadesky et al. | |
| 8,055,003 | B2 | 11/2011 | Mittleman et al. | |
| 8,116,505 | B2 | 2/2012 | Kawasaki-Hedges et al. | |
| 8,116,506 | B2 | 2/2012 | Kuroda et al. | |
| 8,204,266 | B2 | 6/2012 | Munoz et al. | |
| 8,218,397 | B2 | 7/2012 | Chan | |
| 8,340,312 | B2 | 12/2012 | Johnson et al. | |
| 8,395,016 | B2 | 3/2013 | Isele et al. | |
| 8,417,298 | B2 | 4/2013 | Mittleman et al. | |
| 8,447,054 | B2 | 5/2013 | Bharatan et al. | |
| 8,452,037 | B2 | 5/2013 | Filson et al. | |
| 8,488,817 | B2 | 7/2013 | Mittleman et al. | |
| 8,560,309 | B2 | 10/2013 | Pance et al. | |
| 8,620,162 | B2 | 12/2013 | Mittleman | |
| 2003/0157859 | A1 | 8/2003 | Ishikawa | |
| 2004/0203520 | A1 | 10/2004 | Schirtzinger et al. | |
| 2005/0271216 | A1 | 12/2005 | Lashkari | |
| 2006/0072248 | A1 | 4/2006 | Watanabe et al. | |
| 2008/0204379 | A1 | 8/2008 | Perez-Noguera | |
| 2008/0292112 | A1 | 11/2008 | Valenzuela et al. | |
| 2008/0310663 | A1 | 12/2008 | Shirasaka et al. | |
| 2009/0017711 | A1 | 1/2009 | Dilo | |
| 2009/0274315 | A1 | 11/2009 | Carnes et al. | |
| 2011/0002487 | A1 | 1/2011 | Panther et al. | |
| 2011/0221094 | A1 | 9/2011 | Gross et al. | |
| 2012/0082317 | A1 | 4/2012 | Pance et al. | |
| 2012/0177237 | A1 | 7/2012 | Shukla et al. | |
| 2012/0250928 | A1 | 10/2012 | Pance et al. | |
| 2012/0263019 | A1 | 10/2012 | Armstrong-Muntner | |
| 2013/0051601 | A1 | 2/2013 | Kwong | |
| 2013/0101805 | A1 | 4/2013 | Altshuler et al. | |
| 2013/0129122 | A1 | 5/2013 | Johnson et al. | |
| 2013/0259281 | A1 | 10/2013 | Filson et al. | |
| 2014/0093113 | A1 | 4/2014 | Dix et al. | |
| 2014/0113478 | A1 | 4/2014 | Yeung et al. | |
| 2014/0140558 | A1 | 5/2014 | Kwong | |
| 2014/0250657 | A1 | 9/2014 | Stanley et al. | |
| 2014/0255663 | A1 | 9/2014 | Whitley et al. | |
| 2015/0078611 | A1 | 3/2015 | Boozer et al. | |

FOREIGN PATENT DOCUMENTS

| | | |
|---|---|---|
| GB | 2310559 | 8/1997 |
| GB | 2342802 | 4/2000 |
| JP | 2102905 | 4/1990 |
| JP | 2004153018 | 5/2004 |
| JP | 2006297828 | 11/2006 |
| WO | WO03/049494 | 6/2003 |
| WO | WO04/025938 | 3/2004 |
| WO | WO2007/083894 | 7/2007 |
| WO | WO08/153639 | 12/2008 |
| WO | WO2009/017280 | 2/2009 |
| WO | WO2011/057346 | 5/2011 |
| WO | WO2011/061483 | 5/2011 |

OTHER PUBLICATIONS

Pingali et al., "Audio-Visual Tracking for Natural Interactivity," Bell Laboratories, Lucent Technologies, pp. 373-382, Oct. 1999.

* cited by examiner

TEXTILE PRODUCT HAVING REDUCED DENSITY

This application is a continuation of U.S. patent application Ser. No. 15/598,146, filed May 17, 2017, which is a continuation of U.S. patent application Ser. No. 13/802,460, filed Mar. 13, 2013. This application claims the benefit of and claims priority to U.S. patent application Ser. No. 15/598,146, filed May 17, 2017, and U.S. patent application Ser. No. 13/802,460, filed Mar. 13, 2013, which are hereby incorporated by reference herein in their entireties.

TECHNICAL FIELD

Embodiments described herein relate generally to a nonwoven textile product, and more particularly to a nonwoven textile product having a reduced density region and a full density region.

BACKGROUND

Textile products have been in use for thousands of years and come in many forms. One way to classify textile products is by whether they are woven products (such as cotton products, and including knitted textiles) or nonwoven products (such as felt products). Generally, both have many applications and are widely used.

One example of a nonwoven textile is felt, which has been used to make goods for centuries. Felt may be formed by placing randomly aligned wool and/or synthetic fibers under pressure and adding moisture, and optionally chemicals. With sufficient time, heat and water, the fibers bond to one another to form a felt cloth. This process may be known as "wet felting."

As another option, fibers may be formed into a felt through "needle felting." In needle felting, a specialized notched needle is pushed repeatedly in and out of a bundle or group fibers. Notches along the shaft of the needle may grab fibers in a top layer of the bundle and push them downward into the bundle, tangling these grabbed fibers with others. The needle notches face toward the felt bundle, such that the grabbed felt is released when the needle withdraws. As the needle motion continues, more and more fibers are tangled and bonded together, again creating a felt cloth.

Although two different ways to create felt products have been described, it should be appreciated that variants and/or other methods may be employed. Regardless of the production method, however, felts share certain characteristics. For example, felts are often used as an acoustic damper due to their relatively dense natures. Likewise, felt tends to pull apart readily, due to its nonwoven nature, if the integrity of the bonds between the threads is compromised. This tendency to break apart when subjected to certain stresses and/or chemical may limit the usefulness of felt for certain applications.

SUMMARY

Embodiments described herein may take the form of a textile fabric, including: a first volume defined by a first plurality of textile fibers; a second volume adjacent the first volume and comprising: a second plurality of textile fibers; and at least one micro-feature formed in the second volume, the at least one micro-feature reducing a density of the second volume. In certain embodiments, the at least one micro-feature comprises a plurality of microperforations; and the plurality of microperforations cooperate to reduce the density of, and/or allow air flow through, the second volume.

Other embodiments may take the form of a method for fabricating a textile product, including the operations of: defining a feature volume on the textile product; forming a micro-feature in the feature volume; and shaping the textile product into a final configuration.

Additional embodiments and configurations will be apparent upon reading this disclosure.

DETAILED DESCRIPTION

Figure 1A:
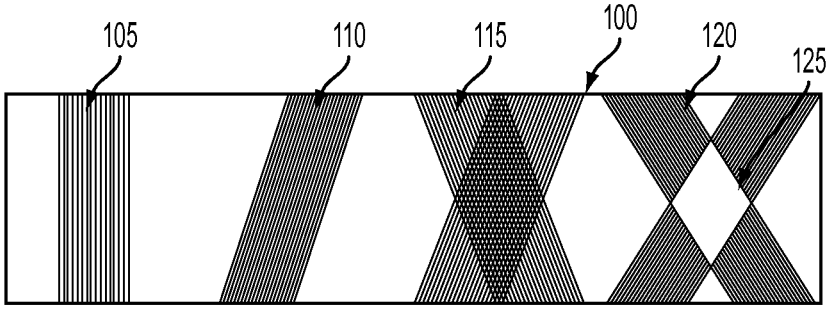
FIG. 1A depicts a magnified view of a portion of a fabric incorporating a variety of microperforation patterns.

Embodiments described herein may take the form of a textile product having one or more regions of selectively reduced density. In certain embodiments, the textile may be a woven fabric, such as a cotton, polyester or the like. In other embodiments, the textile may be a nonwoven fabric, such as a felt.

Generally, embodiments described herein may take the form of a textile product having one or more regions of reduced density. These reduced density volumes or regions may form one or more characteristics in the product. For example, the reduced density volumes may have better acoustic transmission properties, optical transmission properties, flexibility, and the like. Sound transmission may be enhanced not only in terms of clarity, but also overall range. That is, certain audio frequencies that the textile may normally block when in an unaltered state may pass through a textile having reduced density or reduced density regions.

The characteristics may be formed either by introducing microperforations into certain regions to create a reduced textile density, or by introducing microbores into these regions, thereby also creating a reduced textile density. A microperforation generally extends through the textile product, while a microbore does not. Thus, a microbore may extend partially through a textile. The term "microperforation," as used herein, generally encompasses microbores, as well. In this fashion, various patterns may be created in a textile for a variety of effects, many of which are discussed herein. Microperforations and microbores (e.g., "microfeatures") are generally not visible to the naked eye under typical lighting conditions, but may be visible if properly backlit.

Microperforations and/or microbores may be created in a textile product in a variety of ways. For example, a laser may be used to generate microperforations and/or microbores. In certain embodiments, either or both of a carbon dioxide (CO2) and ultraviolet laser may be used to generate microperforations or microbores; other types of lasers may be used in other embodiments. In some embodiments, the laser may have a power of 1 Watt and a 20 kHz frequency. The laser may have a pulse energy of 0.05 microJoules, a speed of 100 nanometers/sec, a wavelength of 355 nanometers, and a spot size of 0.03 micrometers. Generally, a laser with these operating parameters may make between 10 and 1,000 passes to create a microperforation or microbore, or set of the same. The number of passes may vary with the thickness of the textile and/or the depth of the micro-feature(s) being formed.

It should be appreciated that any or all of the foregoing laser parameters may be varied between embodiments. Generally, a laser suitable to create a micro-feature or micro-feature set may have a wavelength from about 10.6 microns to about 355 nanometers, a pulse width ranging from approximately 1 nanosecond to a continuous wave, a frequency ranging from about 5 kHz to a continuous wave, and a spot size of roughly 10 microns to roughly 100 microns. Any or all of the foregoing parameters may change with the type of laser used, as well as the micro-features being created and the physical properties of the textile and/or its fibers.

As another option, the microperforations may be mechanically created by a sufficiently thin awl, needle, or the like. Additional options exist to create microperforations in textiles, as known to those skilled in the art.

FIG. 1A shows a sample set of microperforations 105, 110, 115, 120 extending through a cross-section of a textile product 100 to form reduced density regions. It should be appreciated that the microperforations are meant to be illustrative only; various types of microperforations in various patterns may be used in different embodiments. As shown in FIG. 1A, the microperforations may extend straight through the textile product 100, as with microperforations 105. Alternately, the microperforations 110 may extend through the textile product at an angle; the angle may vary between textile products and/or different portions of a single product.

As a third option, microperforations 115 may extend at multiple angles and intersect one another in a portion of the textile product 100. This may permit even greater reductions in density of the textile in an internal region where the microperforations intersect. By creating internal regions having reduced density of textile fibers, even when compared to surface regions having reduced fiber density, certain characteristics of the textile may be enhanced while the look, feel and other attributes remain unaffected. For example, internal regions like those described herein may increase the range and/or clarity of sound transmitted through the textile. As yet another option, internal voids 125 may be formed by intersecting microperforations 120 and spacing the microperforations appropriately.

Figure 1B:
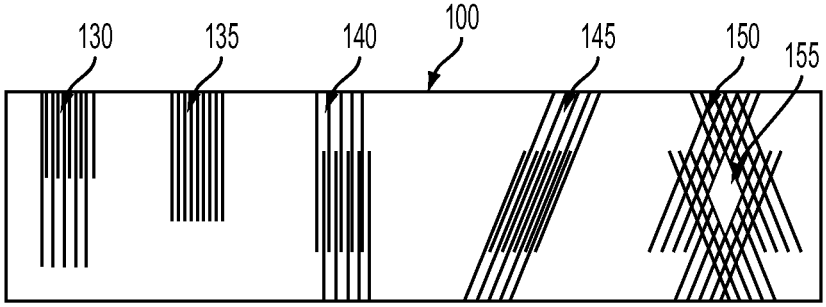
FIG. 1B depicts a magnified view of a portion of a fabric incorporating a variety of microbore patterns.

FIG. 1B illustrates a cross-sectional view of a textile product 100 having various sets of microbores 130, 135, 140, 145, 150 forming reduced density regions. One set of microbores 130 may extend partially through the cross-section of the textile 100 to a uniform depth. As an alternative, microbores in a set or group 135 may extend to differing depths. Each microbore may extend to a different depth, or subsets of microbores may each extend to different depths, as shown. In still another manner, microbores 140 may extend from opposing sides of the textile 100 to form a reduced density region. The microbores 140 generally do not intersect in this embodiment.

Still another set of microbores 145 is similar to the set 140 in that they extend from opposing or different surfaces of the textile 100. Here, however, the microbores 145 enter the textile surface at angles. Another set of microbores 150 may intersect one another, forming a void 155 or cavity within the textile. Again, the microbores 150 may extend from different surfaces of the textile 100.

By changing the spacing, patterning, diameters or thickness, and depth of the microperforations and/or microbores, the physical characteristics and functionality of the various reduced density regions may be changed. Such regions may be optimized or enhanced for particular functions, such as optical transmission, audio transmission, bendability, weight reduction, and the like. As one non-limiting example, the reduced density regions may form acoustic channels that may not only permit sound to pass through the textile 100, but also may channel sound from an entry point to an exit point. It should be appreciated that the exit point need not be directly across from the entry point. Instead, the shape, angle and other attributes of the microperforations/microbores may channel audio to an exit point that is offset in multiple directions from the audio entry point. This may occur, for example, when the microperforations/microbores are at a non-right angle to a surface of the textile 100.

Figure 2:
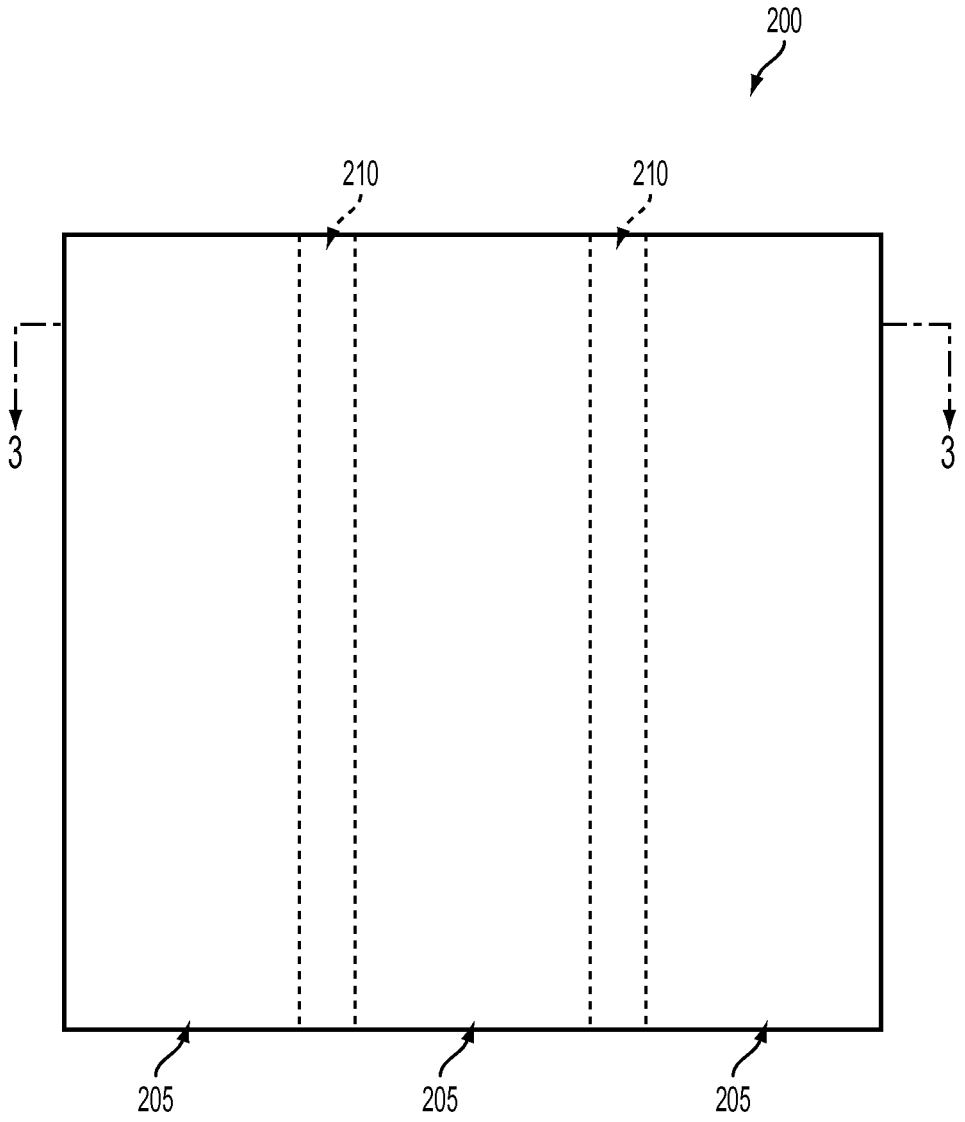
FIG. 2 depicts a sheet of textile material.

FIG. 2 illustrates a sample textile sheet 200 that may be formed into a cover for a tablet computing device (not shown) in accordance with the discussion and methods herein. The textile sheet 200 may be formed from textile fibers 100 (woven or nonwoven). Generally, the textile sheet 200 is patterned into a series of volumes having reduced density 205 and full density 210. The reduced density volumes 205 may have microperforations 105 present therein, while the full density volumes 210 may lack microperforations.

Figure 3A:
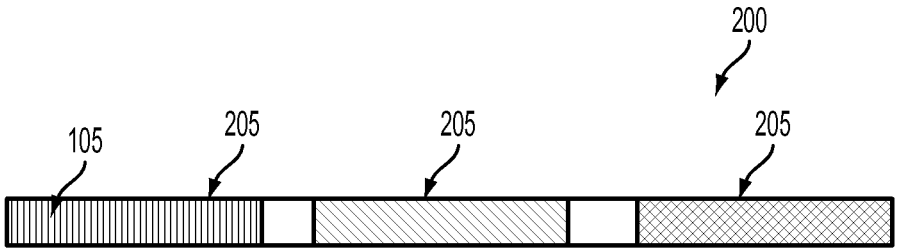
FIG. 3A depicts the sheet of FIG. 2 in cross-section with a number of reduced density volumes formed therein.
Figure 3B:
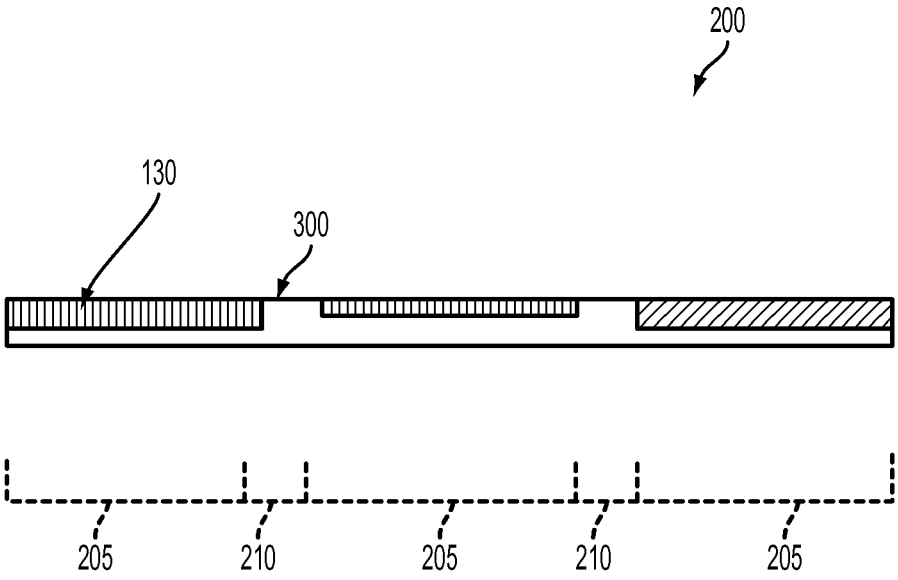
FIG. 3B depicts the sheet of FIG. 2 in cross-section with a number of variant reduced density volumes formed therein.

For example, FIGS. 3A and 3B depict alternative examples of the textile sheet 200 with microperforations 105 in the reduced density volumes 205. In the example of FIG. 2A, the microperforations 105 are interspersed throughout the textile sheet 200 in each reduced density volumes 205. That is, the microperforations may run randomly or semi-randomly throughout the reduced density volumes of the textile sheet. As can be seen in FIG. 2A, there are generally no (or very few, or only incidental) microperforations in the full density volumes 210. As also illustrated, one reduced density volume 205 may have microperforations formed therein in a first pattern, a second reduced density volume may have microperforations formed therein in a second pattern, and so on.

FIG. 3B illustrates an alternative textile fiber sheet 200 having microbores 130 associated therewith. In this embodiment, the microperforations 130 may extend through only a portion of the textile fibers 100 to define a reduced density volume 205, specifically those on an upper surface 300 of the textile sheet 200. That is, the micro perforations may extend partially, but not fully, through the textile sheet 200. Such microperforations may be referred to as "microbores" in some embodiments. It should be appreciated that the term "microperforations," as used herein, is intended to cover microbores as well. As also illustrated in FIG. 3B, the microbores 130 may extend through the textile sheet 200 to different depths, and at different angles or forming different patterns. Full density volumes 210 may be formed between the reduced density volumes 205.

Figure 4:
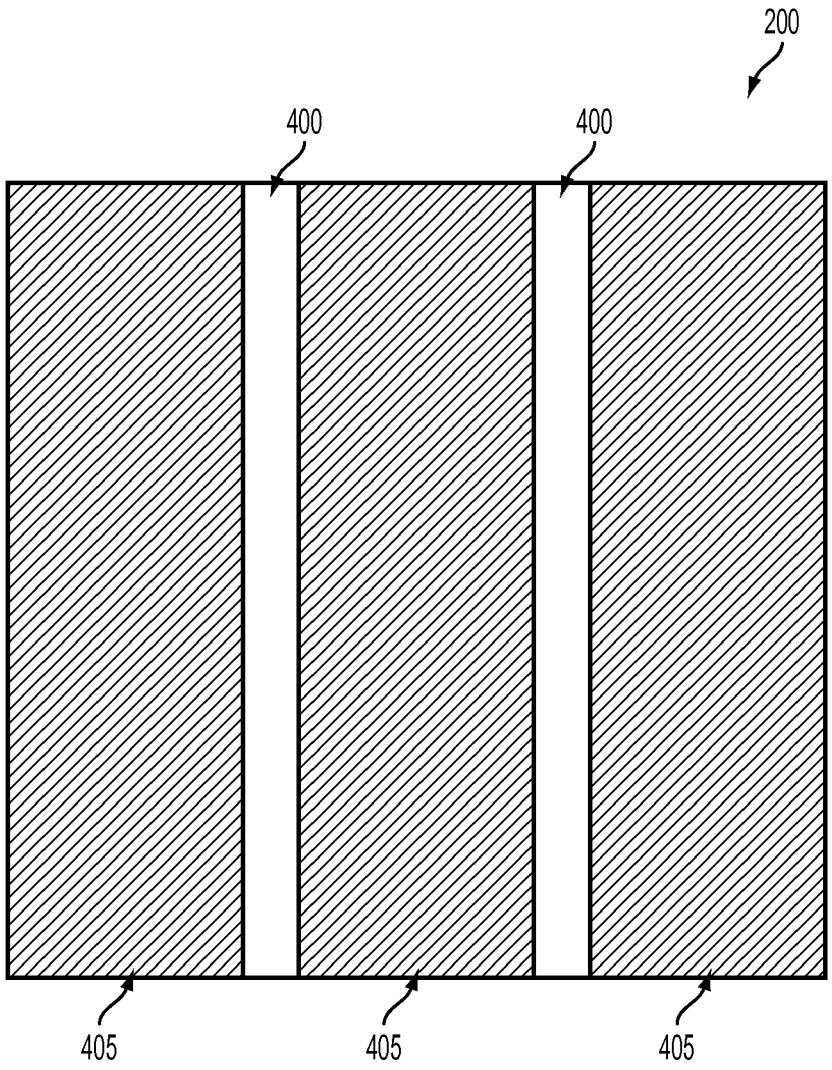
FIG. 4 depicts the sheet of FIG. 3A in a top-down view.

The discussion now turns to FIG. 4. FIG. 4 depicts the textile sheet 200 after formation of the microperforations. As discussed below with respect to FIG. 6, microperforations may be formed in at least the upper surface 300 of the textile sheet 200 (or, in some embodiments, a lower or inner surface of the textile sheet). In many embodiments, microperforations may extend through the entirety of the textile sheet 200.

Selectively thinning or microperforating the textile sheet 200 in specific volumes 400 (generally corresponding to the reduced density volumes 205) to form a desired pattern may provide certain benefits. For example, the reduced density volumes 205 may be altered to be acoustically transmissive or transparent, or near-transparent, even though the textile itself generally may be an acoustic muffle or baffle. Likewise, the reduced density volumes 400 may be thinned or changed sufficiently by the micro-features to be light-transmissive, at least partially. For example, the unprotected volumes may appear translucent when backlit or may emit a relatively diffuse light, or may be at least partially see-through when backlit. As yet another example, the textile sheet may bend more easily in the reduced density volumes 400 after formation of the microperforations while the full density volumes 405 may retain their original stiffness. Thus, by selectively perforating portions of the textile sheet with a laser or in another fashion, the textile sheet 200 may be configured to provide certain functionality that is otherwise lacking in a standard textile sheet.

Figure 5:
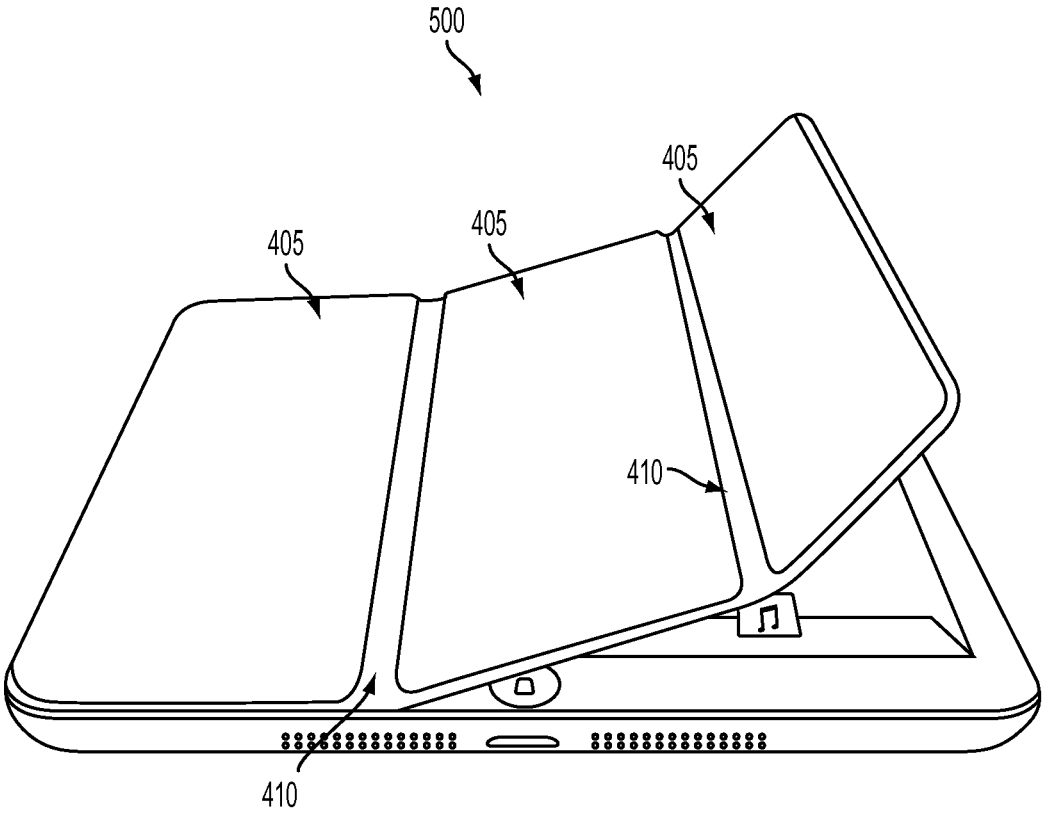
FIG. 5 shows a sample consumer product formed from a textile product having thinned regions.

FIG. 5 shows one example of a cover 500 for an electronic device that may be formed from a textile sheet with one or more reduced density volumes 205, as discussed herein. Generally, the cover 500 may be a finished product corresponding to the textile sheet 200 shown in FIGS. 2 and 4. The cover may bend at the reduced density volumes 205, which may be more flexible due to the microperforations formed therein. The full density volumes 210 may be relatively stiff when compared to the reduced density volumes. Thus, the cover 500 may be configured to selectively bend and/or be reshaped.

Figure 6:
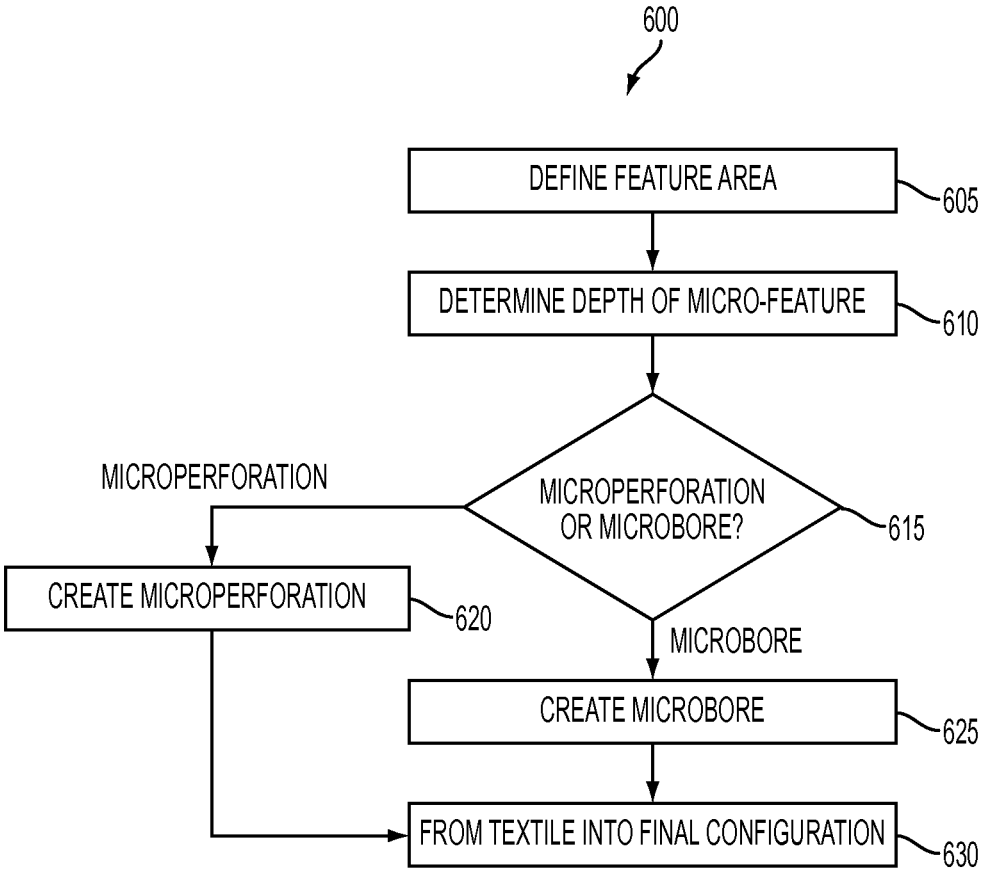
FIG. 6 is a sample method of manufacturing a textile product having thinned regions.

FIG. 6 is a flowchart setting forth general operations in accordance with certain embodiments herein. In method 600, microperforations 105 or microbores 130 are added to a textile sheet 200 to form a particular pattern or patterns. The microperforations may be added or introduced in any fashion described herein.

First, in operation 605, a characteristic volume is defined on a textile sheet. The characteristic volume may be any portion of the sheet that is to be patterned to produce a reduced fiber density in that volume.

In operation 610, the depth of the micro-feature (e.g., microperforation or microbore) that is to be formed in the characteristic volume is determined. The micro-feature depth may depend on a variety of factors. Sample factors may include the thickness of the textile, the diameter or other physical attribute of the micro-feature, the density of the textile, the resulting property desired for the characteristic, the end use of the textile, and so on.

Next, in operation 615, it is determined if a microperforation or microbore is to be formed. This determination may be based, at least in part, on the depth of the micro-feature determined in operation 610.

If a microperforation is to be formed, this is done in operation 620. Otherwise, a microbore is formed in operation 625. Following either operation 620 or 625, the textile is formed into its final configuration in operation 630. It should be appreciated that multiple holes may be formed, and microperforations and microbores may be mixed together either on the same textile or even in the same reduced density volume/characteristic.

Figure 7:
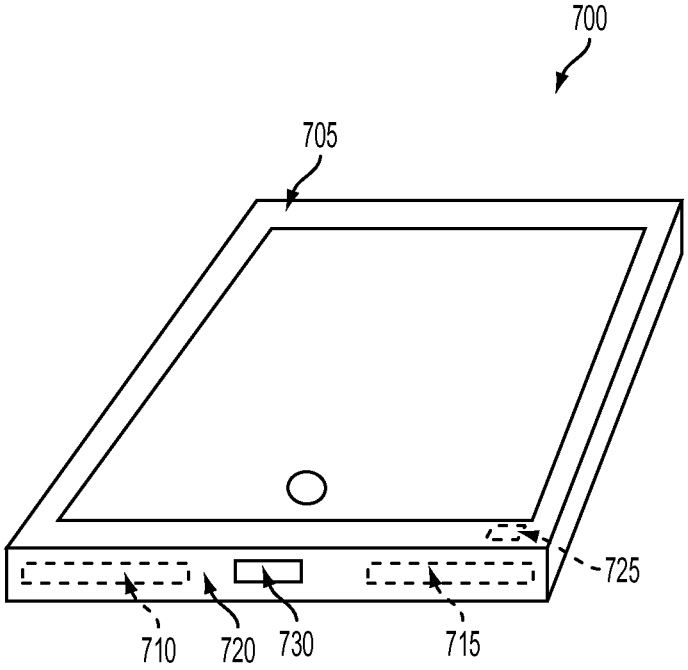
FIG. 7 shows a second sample consumer product formed from a textile product having thinned regions.

It should be appreciated that a variety of items may be made from a textile fabric 200 selectively treated or processed to form microperforations 105 and/or reduced density volumes 205. For example, a variety of covers or cases may be formed. FIG. 7 shows one example of an exterior case 700 for a tablet computing device 705 that may be formed in accordance with the present disclosure. The case 700 may define one or more acoustic outlets 710 and/or acoustic inlets 715. These acoustic outlets/inlets may be reduced density volumes 400 that include microperforations and/or microbores, thereby thinning the textile fabric sufficiently to permit sound to pass therethrough without substantial impedance or distortion. An acoustic outlet 710 may cover a speaker of the tablet computing device 705 while an acoustic inlet 715 may cover a microphone, for example. It should be appreciated that the look of these acoustic outlets 710 and inlets 715 may be identical or substantially similar to the rest of the case 700, including any full density portions 720. Thus, although the acoustic properties of the outlets 710 and inlets 715 may be altered, the visual appearance, and optionally the feel, of these elements may match the rest of the case. The dashed lines signify that these elements, while transmissive, may not form an aperture permitting objects to pass through the textile fabric.

The case 700 may also define a light-transmissive section 725. The light-transmissive section may emit light when backlit. For example, when a status indicator is activated, the outputted light may be visible through the light-transmissive section. In some embodiments the light may be visible even though the status indicator is not.

Through multiple microperforation operations, or through the use of varying concentrations of lasers or other perforating elements selectively applied simultaneously, one or more apertures 730 passing through the exterior case 700 may be formed in the textile material.

It should be appreciated that any number of items may be formed from a textile fabric that is selectively altered in the fashions described herein. For example, textile seat covers for automobiles may be so manufactured. Likewise, grilles or covers for audio elements, such as speakers, may be formed. As still another example, bands or bracelets may be fabricated in this fashion. Covers for other electronic devices, such as telephones and notebook computers, may also be created. Various other products will become apparent to those of ordinary skill in the art upon reading this disclosure in its entirety. Accordingly, the proper scope of protection is set forth in the appended claims.

What is claimed is:

1. An electronic device having a surface, the electronic device comprising:

a speaker that emits sound; and a layer of fabric that overlaps the speaker, wherein the layer of fabric has first and second opposing surfaces, wherein the layer of fabric has an array of openings and wherein a planar portion of the layer of fabric comprises:

a first portion, wherein first openings of the array of openings are in the first portion and have a first density, wherein the first openings extend partially through the layer of fabric, and wherein the first openings extend at a right angle between the first and second surfaces, and a second portion, wherein second openings of the array of openings are in the second portion and have a second density that is greater than the first density, and wherein the sound from the speaker is emitted through the second portion, wherein the first and second portions of the layer of fabric overlap the surface wherein the second openings comprise diamond-shaped openings that form an acoustic outlet for the speaker, wherein the diamond-shaped openings extend from the first surface to the second surface, and wherein the diamond-shaped openings are defined by intersecting perforations in the layer fabric.

2. The electronic device defined in claim 1 wherein and the second openings of the array of openings extend completely through the layer of fabric from the first surface to the second surface.

3. The electronic device defined in claim 2 wherein each second opening in the second portion of the layer of fabric extends at a non-right angle between the first and second surfaces of the layer of fabric.

4. The electronic device defined in claim 1 wherein the array of openings is configured to channel the sound from the speaker from an entrance point at the first layer to an exit point at the second layer.

5. The electronic device defined in claim 4 wherein the exit point is offset from the entrance point in multiple directions.

6. The electronic device defined in claim 1 further comprising a sidewall, wherein the first and second portions of the fabric layer cover the sidewall.

7. The electronic device defined in claim 1 further comprising a light source, wherein the layer of fabric comprises a third portion that covers the light source.

8. The electronic device defined in claim 7 wherein the third portion of the fabric layer has an additional array of openings and wherein the third portion has a greater light transmission than the first portion.

9. An electronic device comprising:

a speaker; and a layer of fabric that overlaps the speaker wherein the layer of fabric has first and second opposing surfaces, wherein the layer of fabric has a first fabric portion and a second fabric portion, wherein the layer of fabric has an array of openings in the first and second fabric portions, wherein the openings in the first fabric portion have a first density and extend partially through the layer of fabric at a right angle between the first and second surfaces, and wherein the openings in the second fabric portion have a second density that is greater than the first density to form an acoustic outlet for the speaker, wherein the openings in the second fabric portion comprise diamond-shaped openings that form the acoustic outlet for the speaker, wherein the diamond-shaped openings extend from the first surface to the second surface, and wherein the diamond-shaped openings are defined by intersecting perforations in the layer of fabric.

10. An electronic device comprising:

a speaker that emits sound; and a layer of fabric having an array of openings, wherein the layer of fabric has opposing first and second surfaces, and wherein the layer of fabric comprises:

a first portion, wherein first openings of the array of openings are in the first portion and extend at a right angle between the first and second surfaces of the layer of fabric phrase wherein the first openings have a first density and extend partially through the layer of fabric, and a second portion, wherein second openings of the array of openings are in the second portion and comprise diamond-shaped openings that extend from the first surface to the second phrase surface of the layer of fabric, wherein the second openings have a second density that is greater than the first density, wherein the diamond-shaped openings form an acoustic outlet for the speaker, and wherein the diamond-shaped openings are defined by intersecting perforations in the layer of fabric.

* * * * *